US010246295B2

(12) United States Patent
Hu et al.

(10) Patent No.: US 10,246,295 B2
(45) Date of Patent: Apr. 2, 2019

(54) PROTECTIVE DEVICE FOR SPEED SENSING DEVICE

(71) Applicant: Otis Elevator Company, Farmington, CT (US)

(72) Inventors: Guohong Hu, Farmington, CT (US); Daryl J. Marvin, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 226 days.

(21) Appl. No.: 15/092,244

(22) Filed: Apr. 6, 2016

(65) Prior Publication Data

US 2017/0291797 A1 Oct. 12, 2017

(51) Int. Cl.

| | |
|---|---|
| ***B66B 5/04*** | (2006.01) |
| ***B66B 5/00*** | (2006.01) |
| ***B66B 5/16*** | (2006.01) |
| ***B66B 9/00*** | (2006.01) |
| ***B66B 5/18*** | (2006.01) |

(52) U.S. Cl.

CPC ..... *B66B 5/044* (2013.01); *B66B 5/0031* (2013.01); *B66B 5/04* (2013.01); *B66B 5/16* (2013.01); *B66B 5/18* (2013.01); *B66B 9/00* (2013.01)

(58) Field of Classification Search

CPC .... B66B 5/14; B66B 5/16; B66B 5/04; B66B 5/0031; B66B 5/18

USPC ..... 359/511

See application file for complete search history.

(56) References Cited

U.S. PATENT DOCUMENTS

| | | | | |
|---|---|---|---|---|
| 4,798,267 | A * | 1/1989 | Foster | B66B 1/3492 187/389 |
| 6,944,908 | B2 | 9/2005 | Hoetzer et al. | |
| 7,324,149 | B2 | 1/2008 | Takizawa et al. | |
| 7,575,099 | B2 * | 8/2009 | Oh | B66B 5/06 187/247 |
| 7,677,364 | B2 | 3/2010 | Begle | |
| 8,307,953 | B2 | 11/2012 | Ferreira | |
| 8,753,025 | B2 | 6/2014 | Suman et al. | |
| 8,866,952 | B2 | 10/2014 | Shimizu et al. | |
| 8,887,183 | B2 | 11/2014 | Matsumura et al. | |
| 8,899,849 | B2 * | 12/2014 | Wada | G03B 17/561 396/427 |

(Continued)

FOREIGN PATENT DOCUMENTS

| | | | |
|---|---|---|---|
| EP | 2666743 A1 * | 11/2013 | B66B 5/18 |
| JP | 2008254837 A * | 10/2008 | |

(Continued)

OTHER PUBLICATIONS

European Search Report, European Application No. 17165093.0, dated Aug. 23, 2017, European Patent Office; European Search Report 6 pages.

(Continued)

*Primary Examiner* — Diem M Tran

(74) *Attorney, Agent, or Firm* — Cantor Colburn LLP

(57) ABSTRACT

A safety actuation assembly for an elevator system including a housing, a speed sensing device disposed within the housing, wherein the speed sensing device comprises a proximal end, and a protection device disposed within the housing and located adjacent to the proximal end of the speed sensing device; the protection device configured to be placed in a first position when in a non-engaging position and in a second position when in an engaging position.

19 Claims, 5 Drawing Sheets

(56) References Cited

U.S. PATENT DOCUMENTS

| | | | | |
|---|---|---|---|---|
| 9,001,319 | B2 | 4/2015 | Tokhtuev et al. | |
| 9,108,596 | B2 | 8/2015 | Stratton | |
| 9,309,091 | B2 * | 4/2016 | Husmann | B66B 5/12 |
| 2009/0133965 | A1 * | 5/2009 | Mattila | B66B 5/048 187/288 |
| 2011/0073142 | A1 | 3/2011 | Hattori et al. | |
| 2011/0266375 | A1 | 11/2011 | Ono et al. | |
| 2013/0334111 | A1 | 12/2013 | Adam | |
| 2015/0040953 | A1 | 2/2015 | Kikuta et al. | |
| 2015/0183406 | A1 | 7/2015 | Tanaka et al. | |
| 2017/0313541 | A1 * | 11/2017 | Wu | B33Y 30/00 |

FOREIGN PATENT DOCUMENTS

| | | | |
|---|---|---|---|
| WO | 2015047391 | A1 | 4/2015 |
| WO | 2015110439 | A1 | 7/2015 |

OTHER PUBLICATIONS

European Patent Office, European Search Report for EP17165093, dated Aug. 15, 2017.

* cited by examiner

PROTECTIVE DEVICE FOR SPEED SENSING DEVICE

TECHNICAL FIELD OF THE DISCLOSED EMBODIMENTS

The present disclosure is generally related to braking and/or safety systems and, more specifically, a protective device for speed sensing device.

BACKGROUND OF THE DISCLOSED EMBODIMENTS

Some machines, such as an elevator system, include a safety system to stop the machine when it moves at excessive speeds or accelerations. In some systems, optical sensing devices may be used to determine the speed of the system. In some elevator systems, dust and debris within the hoistway may obstruct the optical sensor; potentially causing inaccurate readings by the sensing device. There is therefore a need for a means to remove dust and debris from the optical sensing device to maintain proper operation.

SUMMARY OF THE DISCLOSED EMBODIMENTS

In an embodiment, a safety actuation assembly for an elevator system is provided. The safety actuation assembly includes a housing, a speed sensing device disposed within the housing, wherein the speed sensing device comprises a proximal end, and a protection device disposed within the housing and located adjacent to the proximal end of the speed sensing device. The protection device is configured to be placed in a first position when in a non-engaging position and in a second position when in an engaging position. In an embodiment, the protection device is composed of a foam material.

In an embodiment. the safety actuation assembly further includes a lever operably coupled to the protection device. In an embodiment, the safety actuation assembly further includes a protrusion disposed on the lever. In another embodiment, the safety actuation assembly further includes a retention device disposed adjacent to the protection device.

In an embodiment, the safety actuation assembly further includes an elevator component disposed within the housing, the elevator component located adjacent to the protrusion and configured to operate between the engaging position and the non-engaging position. In an embodiment, the elevator component is configured to engage the protrusion when placed in the engaging position.

In an embodiment, the elevator component includes a braking device. In an embodiment, the braking device includes a magnetic braking device, and an electromagnetic component disposed adjacent to the magnetic braking device, wherein the electromagnetic component is configured to hold the magnetic braking device in the non-engaging position.

In one aspect, an elevator system is provided. The elevator system includes a hoistway, a first elevator component disposed within the hoistway and configured to travel within the hoistway, and a safety actuation assembly operably coupled to the first elevator component. In an embodiment, the first elevator component includes at least one of an elevator car and a counterweight.

The safety actuation assembly includes a housing, a speed sensing device configured to determine a speed of the first elevator component, wherein the speed sensing device comprises a proximal end, and a protection device disposed within the housing and located adjacent to the proximal end of the speed sensing device; the protection device configured to be placed in a first position when in a non-engaging position and in a second position when in an engaging position. In an embodiment, the protection device is composed of a foam material.

In an embodiment, the safety actuation assembly further includes a lever operably coupled to the protection device. In an embodiment, the safety actuation assembly further includes a protrusion disposed on the lever. In an embodiment, the safety actuation assembly further includes a retention device disposed adjacent to the protection device.

In an embodiment, the safety actuation assembly further includes a second elevator component disposed within the housing, the second elevator component located adjacent to the protrusion and configured to operate between the engaging position and the non-engaging position. In an embodiment, the second elevator component is configured to engage the protrusion when placed in the engaging position.

In an embodiment, the second elevator component comprises a braking device. In an embodiment, the braking device includes a magnetic braking device and an electromagnetic component disposed adjacent to the magnetic braking device, wherein the electromagnetic component is configured to hold the magnetic braking device in the non-engaging position In an embodiment, the protection device is composed of a foam material.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
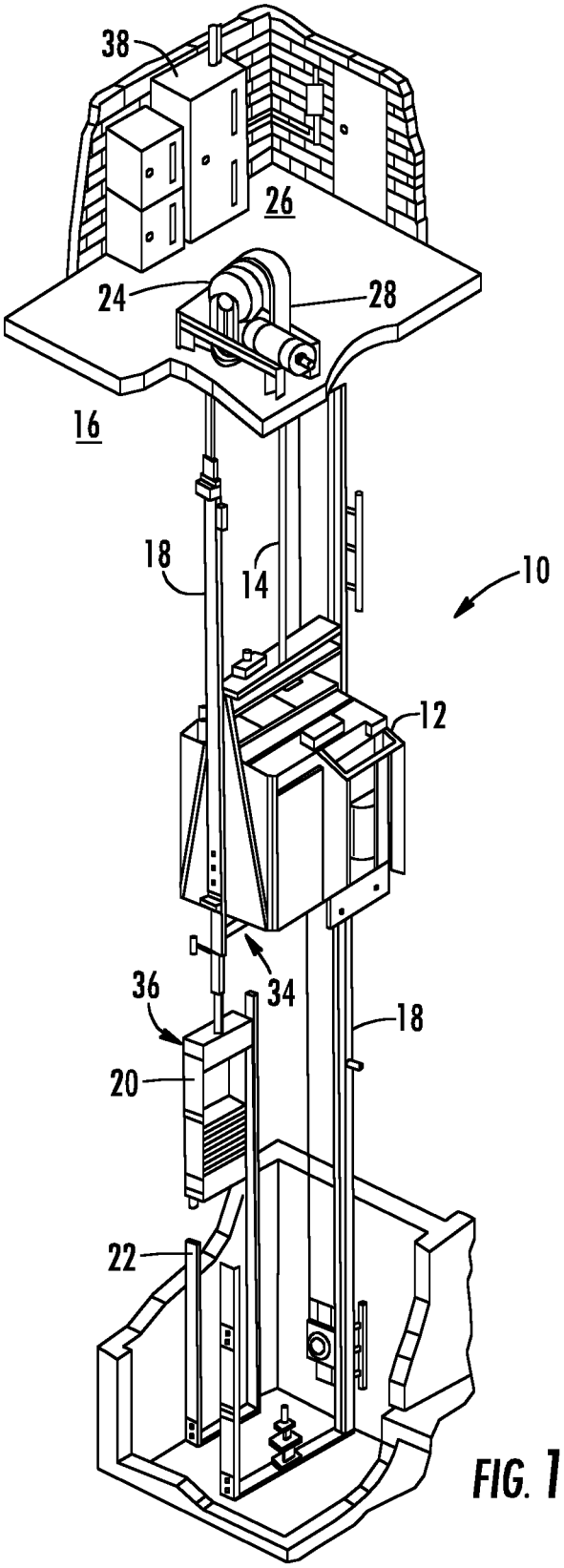
FIG. 1 is a schematic diagram of an elevator system employing a mechanical governor.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 shows an embodiment of an elevator system, generally indicated at 10. The elevator system 10 includes an elevator car 12 suspended by a cable 14 in a hoistway 16. The elevator car 12 is guided between car guide rails 18. A counterweight 20 is guided between counterweight guide rails 22 and is suspended on an opposite end of the cable 14.

Movement of the elevator car 12 and counterweight 20 in the hoistway 16 is provided by a motor 24 mounted in a machine room 26. The motor 24 rotates a sheave 28 around which the cable 14 extends to raise and lower the elevator car 12.

An electromechanical brake (not shown) located in the machine room 26, electronic safety actuation assemblies 40 (shown in FIG. 2), car safeties 34, and/or counterweight safeties 36 act to stop elevator car 12 and counterweight 20 if the elevator car 12 or counterweight 20 exceeds a set speed as they travel inside the hoistway 16. The electronic safety actuation assembly 40 is configured to determine if the elevator car 12 or counterweight 20 reaches a defined over-speed condition; thus, transmitting a signal to an elevator drive 38, which in turn cuts power to the elevator drive 38 and drops the brake to arrest movement of the sheave 28 and thereby arrest movement of elevator car 12 and counterweight 20.

If, however, cables 14 break or the elevator car 12 otherwise experiences a free-fall condition unaffected by the brake, the electronic safety actuation assembly 40 may then act to actuate either or both of the car safety device 34 and counterweight safety device 36 to arrest movement of the elevator car 12 and counterweight 20.

Figure 2:
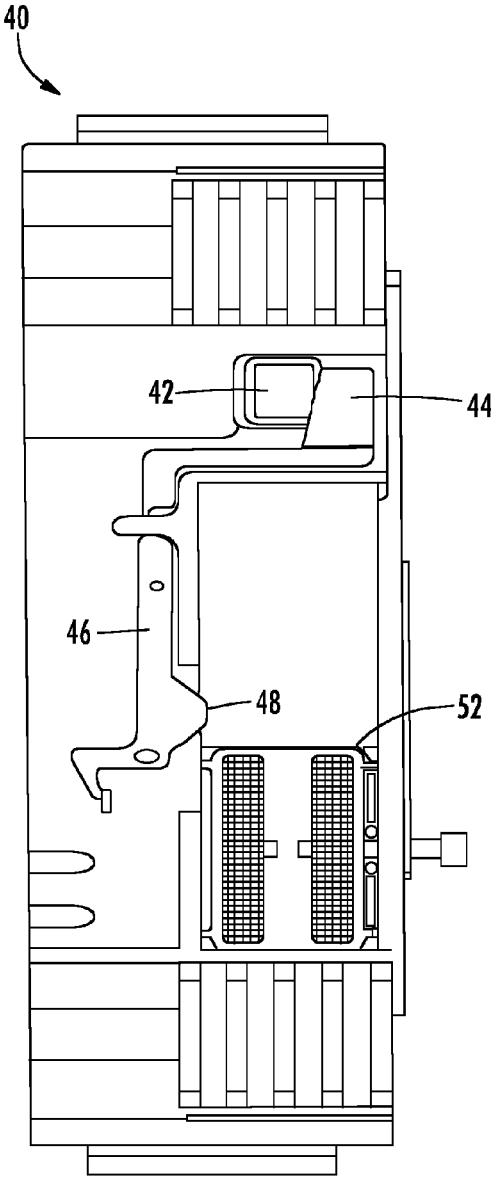
FIG. 2 is a schematic cross-sectional view of a safety actuation assembly in a non-engaging position according to an embodiment of the present disclosure.

FIG. 2 shows an embodiment of a safety actuation assembly 40 in a non-engaging position, the safety actuation assembly 40 is configured to be affixed to at least one of the elevator car 12 and counterweight 20. The safety actuation assembly 40 includes a speed sensing device 42 configured to determine the traveling speed of the elevator car 12 or counterweight 20. In an embodiment, the speed sensing device 42 includes a proximal end, wherein the proximal end is located adjacent to a rail (e.g., car guide rails 18 and/or counterweight guide rails 22). The speed sensing device 42, for example, may be a type of optical sensor that is composed of optical lens and the laser-based, or the infra LED-based tracking component. In order to have accurate speed measurement, it is important to protect the optical sensor from dust contamination.

The safety actuation assembly 40 further includes a protection device 44 disposed adjacent to the proximal end of the speed sensing device 42. The protection device 44 is configured to remove particles or other debris away from the speed sensing device 42. In an embodiment, the protection device 44 may be composed of a cloth, plastic, foam, nylon, or polypropylene. It will be appreciated that the protection device 44 may be composed of any material suitable for removing particles or debris away from the speed sensing device 42.

In an embodiment, the protection device 44 is operably coupled to a lever 46. In an embodiment, the lever 46 includes a protrusion 48, that may be engaged by an elevator component, to actuate movement of the lever 46 and protection device 44 between a first position and a second position. In an embodiment, the elevator component includes a magnetic brake 52 as later described herein. In other embodiments, the elevator component may include an electromechanical device, such as a rotary solenoid with a lever to name one non-limiting example. In the embodiment shown in FIG. 2, the lever 46 and protection device 44 are positioned in the first position.

In the embodiment shown in FIG. 2, the safety actuation assembly 40 includes an electromagnetic component 50 (shown in FIG. 4) and a magnetic brake 52. The electromagnetic component 50 is configured to receive a safety signal from a safety actuation controller (not shown) to actuate the magnetic brake 52 during a freefall event unaffected by the machine brake. The electromagnetic component 50 is configured to hold the magnetic brake 52 in the non-engaging position without power needed. The magnetic brake 52 provides a magnetic attraction force in a direction toward the electromagnetic component 50 to hold the magnetic brake 52 in the non-engaging position.

Figure 3:
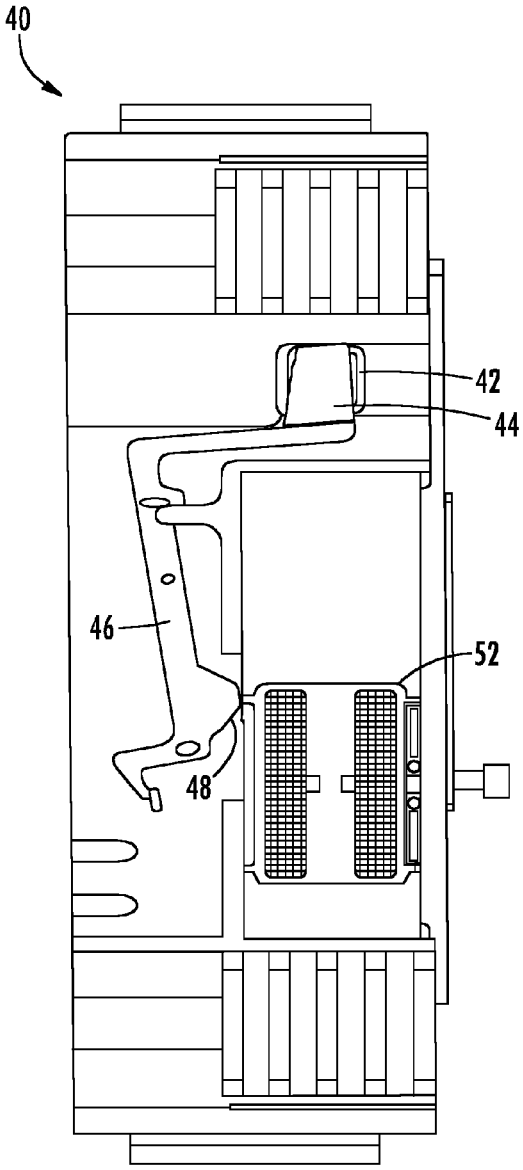
FIG. 3 is a schematic cross-sectional view of a safety actuation assembly in an engaging position according to an embodiment of the present disclosure.
Figure 4:
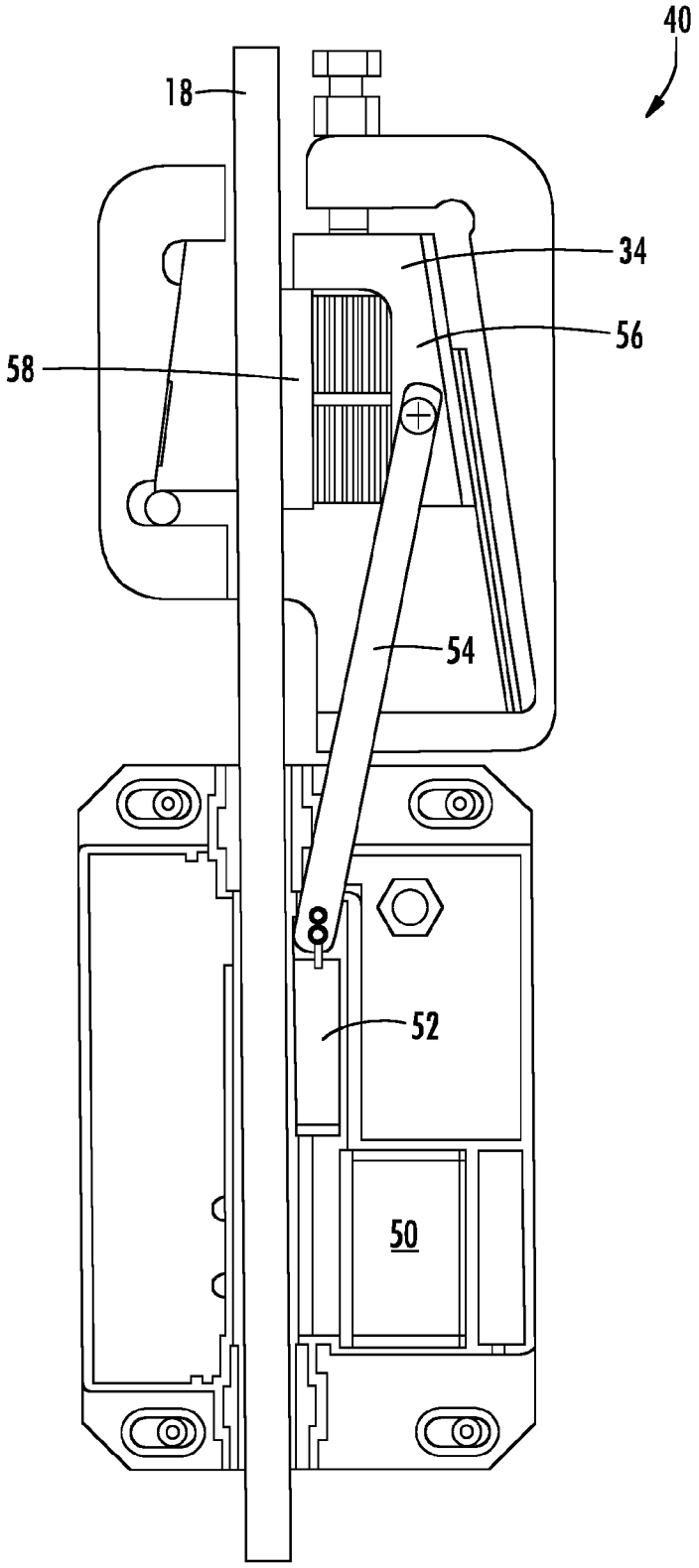
FIG. 4 is a schematic front view of a safety actuation assembly in an engaging position according to an embodiment of the present disclosure.

The magnetic brake 52 may be placed in a rail-engaging position as a result of the repulsion force exerted on the magnetic brake 52 by the electromagnetic component 50 which propels the magnetic brake 52 towards either car guide rails 18 or the counterweight guide rails 22 into a rail-engaging position, as shown in FIGS. 3 and 4. In the rail-engaging position illustrated in FIGS. 3 and 4, the magnetic brake 52 is magnetically attached to the car guide rail 18 or the counterweight guide rail 22.

FIG. 4 illustrates the attached magnetic brake 52 positioned above the electromagnetic component 50 after moving upward with the car guide rails 18 relative to a descending elevator car 12. The magnetic brake 52 is operably coupled to the safety brake 34 by a rod or small linkage bar 54. The magnetic brake 52, in the rail-engaging position, pushes the safety brake 34 in an upward direction due to the relative upward movement of the magnetic brake 52 relative to the descending elevator car 26. The safety brake 34 engages the car guide rail 18 when the magnetic brake 52 pushes the safety brake 34 in the upward direction. A wedge-shaped portion 56 of the safety brake 34 allows a safety brake pad 58 to move toward and engage with the car guide rail 18 upon upward movement of the magnetic brake 52 and the rod 54.

Returning to FIG. 3, when the magnetic brake 52 is in the rail-engaging position, the upward movement causes the magnetic brake 52 to engage the protrusion 48 on the lever 46; thus, causing the lever 46 and protection device 44 to move into a second position. When moving between the first position and second position, the protection device 44 moves across the speed sensing device 42 to remove any particles or debris that may be disposed thereon. It will be appreciated that the elevator system 10 may place the elevator component (e.g., the magnetic brake 52) in an engaging position as a result of an overspeed condition or for the purpose of performing a periodic maintenance action to remove particles or debris from the speed sensing device 42. When performing periodic maintenance, the elevator car 12 may be stopped such that the magnetic brake 52 is placed in an engaging position. The elevator car 12 may then be moved in either an upward or downward direction such that the magnetic brake 52 engages the protrusion 48 on the lever 46 causing the lever 46 and protection device 44 to move into the second position.

In other embodiments, the electromechanical device may be moved once or multiple times to engage the protrusion 48 in order to move the protection device 44 across the speed sensing device 42 to properly perform maintenance. It will be appreciated that the protection device 44 may be actuated based in part on a predefined quality threshold of the speed sensing device 42 (e.g., when the current data from the speed sensing devices 42 is not consistent with prior data). This may occur relatively frequent in very hostile environment, such as building construction phase, or it is infrequent if air quality in the elevator hoistway is good.

Figure 5:
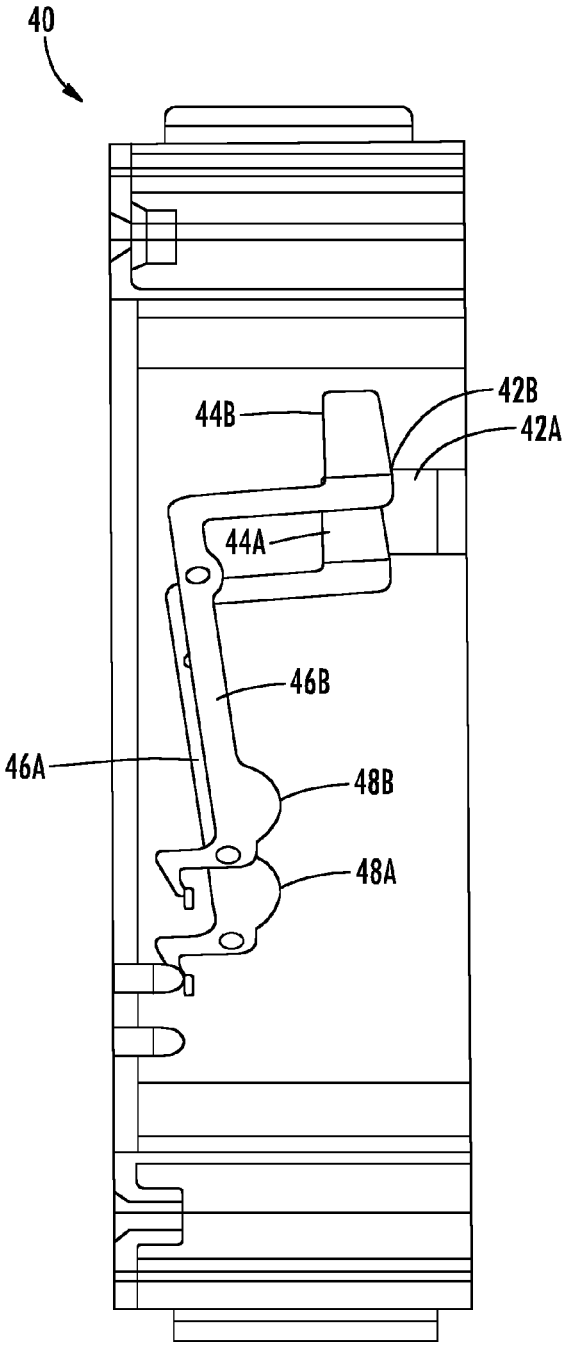
FIG. 5 is a schematic cross-sectional view of a safety actuation assembly according to an embodiment of the present disclosure.

FIG. 5 shows another embodiment of the safety actuation assembly 40. In the embodiment shown, the safety actuation assembly 40 includes a pair of speed sensing devices 42A, 42B disposed adjacently opposite of one another. A pair of protection devices 44A, 44B are operably coupled to a pair of levers 46A, 46B, connected via a connecting device (not shown), for example, a pin to name one non-limiting example. The pair of levers 46A, 46B include protrusions, 48A, 48B, respectively. Similar to the operation as depicted above, when the elevator component (e.g., magnetic brake 52 in the rail-engaging position) engages the protrusions 48A, 48B, the pair of levers 46A, 46B and pair of protection devices 44A, 44B move from a first position to a second position to clean the pair of speed sensing devices 42A, 42B.

Figure 6:
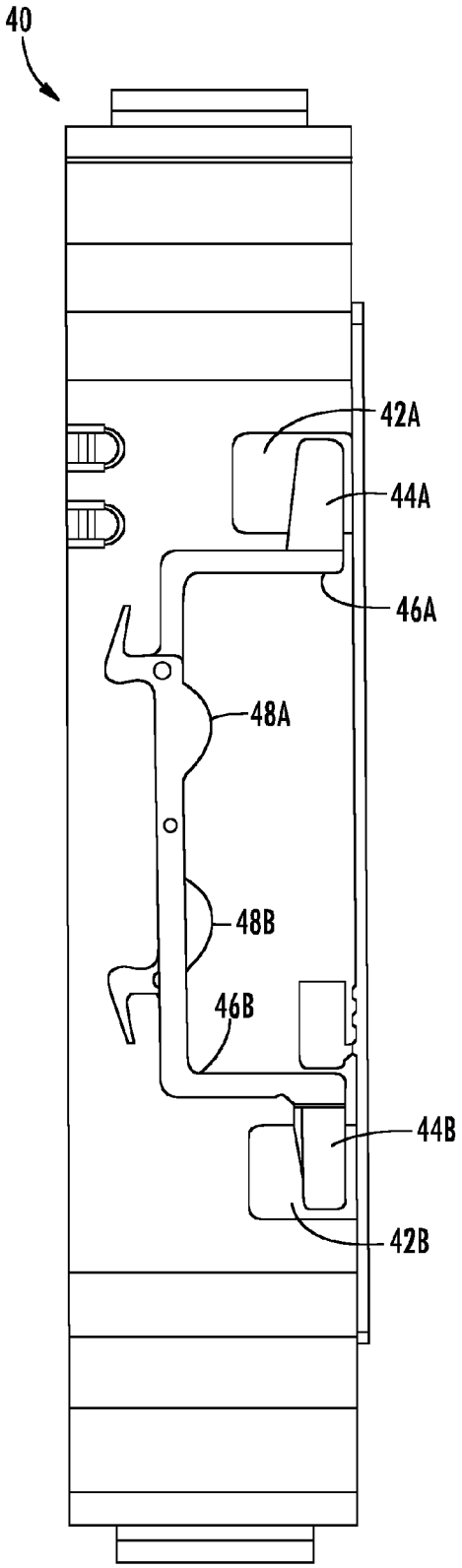
FIG. 6 is a schematic cross-sectional view of a safety actuation assembly according to an embodiment of the present disclosure.

FIG. 6 shows another embodiment of the safety actuation device 40. In the embodiment shown, the safety actuation device 40 includes a pair of speed sensing devices 42A, 42B disposed opposite of one another. A pair of protection devices 44A, 44B are operably coupled to a pair of levers 46A, 46B, connected via a connecting device (not shown), for example, a pin to name one non-limiting example. The pair of levers 46A, 46B include protrusions, 48A, 48B, respectively. Similar to the operation as depicted above, when the elevator component (e.g., magnetic brake 52 is in the rail-engaging position) engages the protrusions 48A, 48B, the pair of levers 46A, 46B and pair of protection devices 44A, 44B move from a first position to a second position to clean the pair of speed sensing devices 42A, 42B.

Figure 7:
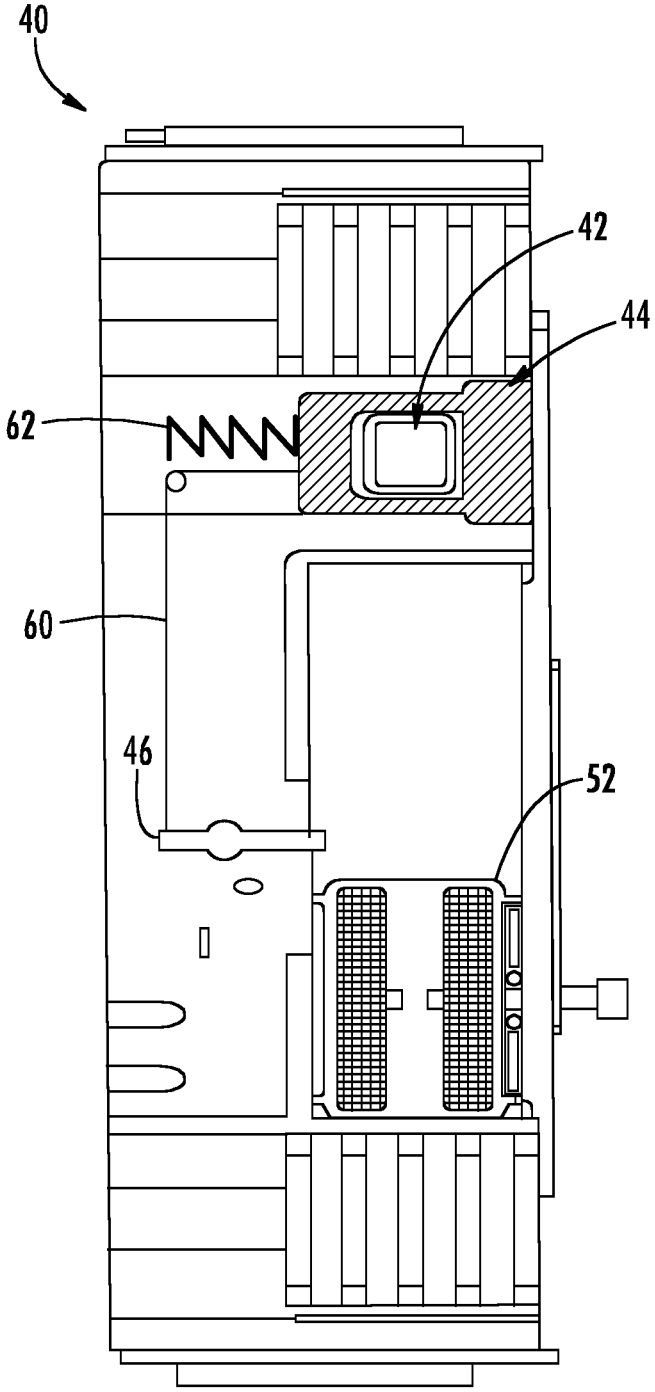
FIG. 7 is a schematic cross-sectional view of a safety actuation assembly according to an embodiment of the present disclosure.

FIG. 7 shows another embodiment of the safety actuation assembly 40. In the embodiment shown, the protection device 44 is operably coupled to the lever 46 via a wire 60. The protection device 44 is held in the first position via a retention device 62, for example a spring to name one non-limiting example. When the elevator component (e.g. magnetic brake 52 is in the rail-engaging position) engages and rotates the lever 46 to pull the wire 60; thus, moving the protection device 44 to the second position. When the elevator component (e.g., magnetic brake 52) disengages the lever 46 and returns to the non-engaging position, the retention device 62 forces the protection device 44 to the first position; thus, moving the lever 46 back to its original (i.e., first) position.

It will therefore be appreciated that the present elevator system 10 includes a safety actuation device 40 that includes a protection device 44 disposed adjacent to a speed sensing device 42 such that the protection device 44 may remove particles away from the speed sensing device 42 when placed in a second position to ensure proper operation and functionality in detecting the speed of the elevator car 12.

While the disclosure has been illustrated and described in detail in the drawings and foregoing description, the same is to be considered as illustrative and not restrictive in character, it being understood that only certain embodiments have been shown and described and that all changes and modifications that come within the spirit of the disclosure are desired to be protected.

What is claimed is:

1. An elevator system having a safety actuation assembly comprising:

a housing;

a speed sensing device for sensing the speed of the elevator system disposed within the housing, wherein the speed sensing device comprises a proximal end; and a protection device disposed within the housing and located adjacent to the proximal end of the speed sensing device;

wherein the protection device configured to be placed in a first position when in a non-engaging position and a second position when in an engaging position.

2. The safety actuation assembly of claim 1, further comprising a lever operably coupled to the protection device.

3. The safety actuation assembly of claim 2, further comprising a protrusion disposed on the lever.

4. The safety actuation assembly of claim 3, further comprising an elevator component disposed within the housing, the elevator component located adjacent to the protrusion and configured to operate between the engaging position and the non-engaging position.

5. The safety actuation assembly of claim 4, wherein the elevator component is configured to engage the protrusion when placed in the engaging position.

6. The safety actuation assembly of claim 5, wherein the elevator component comprises a braking device.

7. The safety actuation device of claim 6, wherein the braking device comprises:

a magnetic braking device; and an electromagnetic component disposed adjacent to the magnetic braking device, wherein the electromagnetic component is configured to hold the magnetic braking device in the non-engaging position.

8. The safety actuation device of 2, further comprising a retention device disposed adjacent to the protection device.

9. The safety actuation device of claim 1, wherein the protection device is composed of a foam material.

10. An elevator system comprising:

a hoistway;

a first elevator component disposed within the hoistway and configured to travel within the hoistway; and a safety actuation assembly operably coupled to the first elevator component, the safety actuation assembly comprising:

a housing;

a speed sensing device disposed within the housing configured to determine a speed of the first elevator component, wherein the speed sensing device comprises a proximal end;

a protection device disposed within the housing and located adjacent to the proximal end of the speed sensing device; the protection device configured to be placed in a first position when in a non-engaging position and in a second position when in an engaging position.

11. The elevator system of claim 10, wherein the first elevator component comprises at least one of an elevator car and a counterweight.

12. The elevator system of claim 10, wherein the safety actuation assembly further comprises a lever operably coupled to the protection device.

13. The elevator system of claim 12, wherein the safety actuation assembly further comprises a protrusion disposed on the lever.

14. The elevator system of claim 13, wherein the safety actuation assembly further comprises a second elevator component disposed within the housing, the second elevator component located adjacent to the protrusion and configured to operate between the engaging position and the non-engaging position.

15. The elevator system of claim 14, wherein the second elevator component is configured to engage the protrusion when placed in the engaging position.

16. The elevator system of claim 15, wherein the second elevator component comprises a braking device.

17. The elevator system of claim 16, wherein the braking device comprises:

a magnetic braking device; and an electromagnetic component disposed adjacent to the magnetic braking device, wherein the electromagnetic component is configured to hold the magnetic braking device in the non-engaging position.

18. The elevator system of claim 10, wherein the safety actuation assembly further comprises a retention device disposed adjacent to the protection device.

19. The elevator system of claim 10, wherein the protection device is composed of a foam material.

* * * * *